United States Patent [19]

Vachon et al.

[11] 4,136,069

[45] Jan. 23, 1979

[54] HOT MELT SIZING COMPOSITIONS AND FIBROUS ARTICLES SIZED THEREWITH

[75] Inventors: Raymond N. Vachon; Richard L. McConnell, both of Kingsport, Tenn.

[73] Assignee: Eastman Kodak Company, Rochester, N.Y.

[21] Appl. No.: 794,181

[22] Filed: May 5, 1977

Related U.S. Application Data

[63] Continuation of Ser. No. 597,122, Jul. 18, 1975, abandoned.

[51] Int. Cl.[2] ..... C08L 23/08

[52] U.S. Cl. ..... 260/23 AR; 252/8.6; 260/897 B; 260/28.5 R; 428/375; 428/392; 428/394

[58] Field of Search ..... 428/375, 394, 392, 393; 252/8.6; 57/14 DC; 260/23 AR, 897 B, 28.5 R

[56] References Cited

U.S. PATENT DOCUMENTS

| | | | |
|---|---|---|---|
| 3,711,430 | 1/1973 | Rubens | 260/2.5 B |
| 3,739,567 | 6/1973 | Williamson | 57/153 |
| 3,904,805 | 9/1975 | Johnson et al. | 428/378 |

*Primary Examiner*—Carman J. Seccuro

*Attorney, Agent, or Firm*—Clyde L. Tootle; Daniel B. Reece, III

[57] ABSTRACT

Compositions suitable for use as hot-melt textile warp sizes are prepared by blending copolymers of ethylene and acrylic acid, methacryclic acid and the like, with selected low-molecular-weight additives, such as low-molecular-weight ethylene/acrylic acid copolymers, ethylene/methacrylic acid copolymers, and/or dicarboxylic acids, monoglycerides and waxes. These blends have low melt viscosities, can be readily applied to textile yarns with conventional hot-melt application equipment and set up rapidly to nontacky protective coatings on the yarns. After processing of the yarns, the new hot-melt sizes are readily removable using conventional scouring procedures.

8 Claims, No Drawings

HOT MELT SIZING COMPOSITIONS AND FIBROUS ARTICLES SIZED THEREWITH

This is a continuation of Application Ser. No.597,122 filed July 18, 1975, now abandoned.

This invention relates to compositions useful as hot-melt sizing materials for textile warps. More specifically, this invention discloses compositions prepared by the melt-blending of relatively high molecular weight ethylene/acrylic acid copolymers which are dispersible in water or dilute base, with low molecular weight ethylene/acrylic acid copolymers, certain dicarboxylic acids, and water or base soluble or dispersible waxes, fatty acids, monoglycerides, and the like.

It is desirable before the weaving process to treat the warp yarns with a sizing composition (sometimes referred to as an "agent") which adheres to the yarns and minimizes the hairiness and fuzziness of the yarns. This treatment also strengthens the yarns and renders them more resistant to abrasion during subsequent weaving operations. It is especially important that the sizing composition impart abrasion resistance to the yarns during weaving because abrasion can cause yarn breakage which reduces the efficiency of the weaving operation and can result in lower quality in the final woven product. It is also important that the sizing composition be one which can be subsequently removed from the yarns by scouring.

Sizing compositions being used in the art today are, for the most part, either water soluble or dispersible and are generally applied to the yarns from aqueous systems. A subsequent drying step is therefore required so that yarns can be wound on a beam without blocking or sticking to each other. The drying operation requires a considerable amount of energy and also limits the speeds at which yarns can be slashed. Application of the size in the form of a hot-melt conserves energy by eliminating the drying step, and allows yarns to be slashed at speeds significantly greater than by conventional slashing methods.

A hot-melt size must also have sufficiently low melt viscosity at the temperature of application in order to rapidly melt coat the yarns at the high speed required. The film must set-up rapidly and be nontacky in order to avoid blocking on the beam. It should also have sufficient strength, elongation and flexibility in order to protect the yarns during the weaving operation and not be removed by the mechanical action of the loom. Finally, the size must be water-dispersible or dispersible in dilute base so that it can be easily removed in conventional textile scouring conditions.

It is therefore an object of this invention to provide novel hot melt sizing compositions.

Another object of the present invention is to provide hot melt sizing compositions which provide improved protection for fibrous articles during processing.

These and other objects of this invention are obtained by a hot melt size composition prepared by melt blending water or base-dispersible high molecular weight copolymers of ethylene and $\alpha,\beta$-unsaturated carboxylic acids such as acrylic and methyacrylic acid and the like, with certain low molecular weight copolymers of ethylene and $\alpha,\beta$-unsaturated carboxylic acids such as acrylic and methacrylic acid and the like. The low molecular weight copolymers of ethylene and acrylic acid, ethylene and methacrylic acid and the like, when blended with the higher molecular weight copolymers, reduce the melt viscosity and help to maintain good film properties. Selected dicarboxylic acids may also be added to lower the melt viscosity of the copolymers and to cause the blends to set up rapidly to nontacky, nonblocking coatings. Selected waxes, fatty acids and monoglycerides may also be added as additional viscosity reducers, and which on cooling tend to migrate to the surface of the films and act as antiblock agents and lubricants.

The high molecular weight copolymers of ethylene/$\alpha,\beta$-unsaturated carboxylic acids such as acrylic and methacrylic acid and the like, contain 75–90 weight percent ethylene and 25–10 weight percent of the acid monomer (preferred range 15–22 weight percent acid monomer). These copolymers have a melt viscosity of about 10,000 to 200,000 cp. at 190° C. (preferred range 20,000–100,000 cp.) and are dispersible in hot water or dilute base. An example of such a copolymer is Union Carbide's Bakelite EAA-9500 (80/20 ethylene/acrylic acid copolymer; melt viscosity 30,000 cp. at 190° C.; acid number 160).

The low molecular weight copolymers of ethylene/acrylic acid, ethylene/methacrylic acid and the like should have a melt viscosity of about 1500 cp. to about 100 cp. at 140° C. and be compatible with the higher molecular weight copolymer. The low molecular weight copolymer does not have to be dispersible in water or dilute base by itself but must be dispersible when blended with other components.

The preferred low molecular weight ethylene copolymers contain about 8–15 weight percent acrylic acid or other acid monomers. Operable copolymers may contain about 5–20 weight percent of the acid monomer. An example of such a low molecular weight copolymer is Allied Chemical's AC-580, a 90/10 ethylene/acrylic acid copolymer.

The dicarboxylic acids useful in this invention are crystalline, aliphatic or alicyclic dicarboxylic acids melting below 170° C. and stable at the temperatures of application. Examples of dicarboxylic acids that can be used in this invention are cyclohexane 1,3-dicarboxylic acid and those having the general formula $HOOC(CH_2)_nCOOH$ where n = 3–10. Azelaic acid is a preferred acid of this invention.

The preferred waxes used in this invention are solids melting below 170° C. and stable at the temperature of application, preferably with melting points above 90° C. The waxes must be dispersible in hot water or dilute base with detergent when blended with the other components. Examples of such waxes are Fischer-Tropsch waxes, such as Vebafine FT-300 (Veba-Chemie) and predominantly hydrocarbon waxes such as Resin H (Eastman Chemical Products).

The fatty acids useful in this invention are solids or liquids of the general formula $CH_3(CH_2)_x(CH{=}CH)_y(CH_2)_zCOOH$ where $x = 5–11$ $y = 0, 1$ or $2$ $z = 5–11$ Preferred acids are stearic acid and oleic acid.

Monoglycerides used in this invention are crystalline solids melting below 170° C. and stable at the temperature of application. A preferred monoglyceride is Eastman's Myverol 18-06.

Blends that are useful as hot-melt sizes contain 35–80 weight percent of the higher molecular weight copolymers of ethylene/acrylic acid, methacrylic acid and the like (preferred range 30–50 weight percent), 5–50 weight percent of the low molecaulr weight copolymer (preferred range 10–40 weight percent), 0–50 weight percent of the dicarboxylic acid (preferred range 5–40 weight percent), and 0–30 weight percent of wax, fatty acid or monoglyceride (preferred range 5–20 weight percent).

Various additives may be incorporated into the sizing compositions for various specific results. Examples of such additives include plasticizers, lubricants, antistatic agents and antioxidants and the like.

The hot melt size compositions of the present invention have low melt viscosities, can be readily applied to textile yarns with conventional hot-melt application equipment and set up rapidly to non-tacky protective coatings on the yarns. After processing of the yarns, the new hot-melt sizes are readily removable using conventional scouring procedures.

The invention can be further illustrated by the following examples of preferred embodiments thereof, although it will be understood that these examples are included merely for purposes of illustration and are not intended to limit the scope of the invention unless otherwise specifically indicated.

EXAMPLE 1

A mixture containing 50 weight percent of an 80/20 ethylene/acrylic acid copolymer (melt viscosity 30,000 cp. at 190° C.), e.g., Bakelite EAA-9500 produced by United Carbide Corp., 40 weight percent of azelaic acid, and 10 weight percent of a 90/10 ethylene/acrylic acid copolymer (melt viscosity 650 cp. at 140° C.), such as AC-580 produced by Allied Chemical Corp., was melt blended at 160° C. Tetrakis[methylene-(3,5-di-tert-butyl-4-hydroxyhydrocinnamate)methane] (Irganox 1010), was added to the mixture before blending at a concentration of 0.3% based on the weight of solids in the blend.

The blended melt had a Brookfield viscosity of 7200 cp. at 160° C. A thin film of the melt set-up rapidly to a nontacky film that had a breaking strength of 925 psi. and 23% elongation at 50% R.H. The film is flexible and disperses readily in a solution containing 2 g./l. NaOH and 2 g./l. of a detergent or emulsifier such as Igepon TN-74 (Antara Chemicals) at 200° F.

This material is useful as a hot-melt size for spun yarns made of natural or synthetic fibers or blends of both.

EXAMPLE 2

A mixture containing 40 weight percent of an 80/20 ethylene/acrylic acid copolymer (melt viscosity 30,000 cp. at 190° C.), 35 weight percent of an ethylene/acrylic acid copolymer (melt viscosity 650 cp. at 140° C.), 25 weight percent azelaic acid, and 0.3% Irganox 1010 (based on weight of solids) was melt blended at 160° C.

The melted blend had a Brookfield viscosity of 4900 cp. at 160° C. A thin film of the melt set-up rapidly to a nontacky film which had a breaking strength of 900 psi. and an elongation at break of 86% at 50% R.H. The films had good flexibility and dispersed readily in a solution containing 2 g./l. NaOH and 2 g./l. Igepon TN-74 at 200° F.

This material is useful as a hot-melt size for spun yarns made of natural or synthetic fibers or blends of both.

EXAMPLE 3

A mixture containing 40 weight percent of an 80/20 ethylene/acrylic acid copolymer (melt viscosity 30,000 cp. at 190° C.), 35 weight percent of a 90/10 ethylene/acrylic acid copolymer (melt viscosity 650 cp. at 140° C.), 15 weight percent azelaic acid, 10 weight percent of a monoglyceride, e.g., Eastman Chemical's Myverol 18-06, and 0.3% Irganox 1010 (based on weight of solids) was melt blended at 160° C.

The melted blend had a Brookfield viscosity of 2950 cp. at 160° C. A thin film of the melt set-up rapidly to a nontacky film which had a breaking strength of 633 psi. and an elongation to break of 39% at 50% R.H. The film was flexible and dispersed readily in a solution containing 2 g./l. NaOH and 2 g./l. of Igepon TN-74 at 200° F.

This material is useful as a hot-melt size for spun yarns made of natural or synthetic fibers or blends of both.

EXAMPLE 4

A mixture containing 30 weight percent of an 82/18 ethylene/acrylic acid copolymer (melt viscosity 100,000 cp. at 190° C.), 40 weight percent of a 90/10 ethylene/methacrylic acid copolymer (melt viscosity 500 cp. at 140° C.), 35 weight percent of a monoglyceride, e.g., Eastman Chemical's Myverol 18-06, and 0.3% Irganox 1010 (based on weight of solids), was melt blended at 160° C.

The melted blend had a Brookfield viscosity of 3500 cp. at 160° C. A thin film of the melt set-up rapidly to a nontacky film which had a breaking strength of 600 psi. and an elongation to break of 50% at 50% R.H.

The film was flexible and dispersed readily in a solution containing 2 g./l. of Igepon TN-74 at 200° F. This material is useful as a hot-melt size for spun yarns made of natural or synthetic fibers or blends of both.

EXAMPLE 5

A mixture containing 40 weight percent of an 80/20 ethylene/acrylic acid copolymer (melt viscosity 30,000 cp. at 190° C.), 40 weight percent of a 90/10 ethylene/acrylic acid copolymer (melt viscosity 650 cp. at 140° C.), 20 weight percent of a monoglyceride, e.g., Eastman Chemical's Myverol 18-06, and 0.3% Irganox 1010 (based on weight of solids) was melt blended at 160° C.

The melted blend had a Brookfield viscosity of 2230 cp. at 160° C. A thin film of the melt set-up rapidly to a nontacky film which had a breaking strength of 693 psi. and an elongation to break of 87% at 50% R.H. The film was flexible and dispersed readily in a solution containing 2 g./l. NaOH and 2 g./l. of Igepon TN-74 at 200° F.

This material is useful as a hot melt size for spun yarns made of natural or synthetic fibers or blends of both.

EXAMPLE 6

A mixture containing 40 weight percent of an 80/20 ethylene/acrylic acid copolymer (melt viscosity 30,000 cp. at 190° C.), 40 weight percent of a 90/10 ethylene/acrylic acid copolymer (melt viscosity 650 cp. at 140° C.), 17.5% of a monoglyceride, e.g., Eastman Chemical's Myverol 18-06, 2.5 weight percent of a Fischer, Tropsch wax, e.g., Veba-Chemie's Vebafine FT-300, and 0.3% Irganox 1010 (based on weight of solids) was melt blended at 160° C.

The melted blend had a Brookfield viscosity of 2270 cp. at 160° C. A thin film of the melt set up rapidly to a nontacky film which had a breaking strength of 672 psi. and an elongation to break of 48% at 50% R.H. The film was flexible and dispersed readily in a solution of 2 g./l. NaOH and 2 g./l. of Igepon TN-74 at 200° F. This material is useful as a hot melt size for spun yarns made of natural or synthetic fibers or blends of both.

Although the invention has been described in considerable detail with particular reference to certain preferred embodiments thereof, variations and modifications can be effected within the spirit and scope of the invention.

We claim:

1. A composition useful as a textile sizing composition comprising: a blend of about 35–80 weight percent of at least one member of the group consisting of copolymers consisting of ethylene and $\alpha,\beta$-unsaturated carboxylic acids containing 75–90 weight percent ethylene and having a melt viscosity of about 10,000 to 200,000 cp. at 190° C. and about 5 to 50 weight percent of at least one member of the group consisting of copolymers consisting of ethylene and $\alpha,\beta$-unsaturated carboxylic acids containing about 80–95 weight percent ethylene and having a melt viscosity of about 1500 cp. to 100 cp. at 140° C.

2. A composition according to claim 1 which contains about 0 to 50 weight percent of at least one dicarboxylic acid.

3. A composition according to claim 1 which contains about 0 to 30 weight percent of at least one member of the group consisting of wax, fatty acid and monoglyceride.

4. A composition according to claim 2 which contains about 0 to 30 weight percent of at least one member of the group consisting of wax, fatty acid and monoglyceride.

5. A composition useful as a textile sizing composition comprising: a blend of about 30–50 weight percent of at least one member of the group consisting of copolymers consisting of ethylene/acrylic acid and ethylene/methacrylic acid containing 78–85 weight percent ethylene and having a melt viscosity of about 20,000 to 100,000 cp. at 190° C. and about 10 to 40 weight percent of at least one member of the group consisting of copolymers consisting of ethylene/acrylic acid and ethylene/methacrylic acid containing about 85–92 weight percent ethylene and having a melt viscosity of about 1500 cp. to 100 cp. at 140° C.

6. A composition according to claim 1 which contains about 5 to 40 weight percent of at least one dicarboxylic acid.

7. A composition according to claim 1 which contains about 5 to 20 weight percent of at least one member of the group consisting of wax, fatty acid and monoglyceride.

8. A composition according to claim 2 which contains about 5 to 20 weight percent of at least one member of the group consisting of wax, fatty acid and monoglyceride.

* * * * *